US005302137A

United States Patent [19]

Suffi

[11] Patent Number: 5,302,137

[45] Date of Patent: Apr. 12, 1994

[54] INSULATION DISPLACEMENT CONNECTOR TERMINAL BLOCK

[75] Inventor: Louis Suffi, Westchester, Ill.

[73] Assignee: Reliance Comm/Tec Corporation, Mayfield Heights, Ohio

[21] Appl. No.: 52,061

[22] Filed: Apr. 22, 1993

[51] Int. Cl.[5] ..... H01R 4/24

[52] U.S. Cl. ..... 439/403; 439/417

[58] Field of Search ..... 439/395–406, 439/409, 417–419, 709, 721, 723, 725

[56] References Cited

U.S. PATENT DOCUMENTS

| | | | |
|---|---|---|---|
| 3,957,335 | 5/1976 | Troy | 339/125 R |
| 4,059,331 | 11/1977 | Sedlacek et al. | 339/198 R |
| 4,106,837 | 8/1978 | Paluch | 339/98 |
| 4,295,703 | 10/1981 | Osborne | 439/403 |
| 4,652,070 | 5/1987 | Suffi | 339/97 |
| 4,919,622 | 4/1990 | Suffi | 439/395 |
| 4,964,812 | 10/1990 | Siemon et al. | 439/403 |
| 5,120,247 | 9/1992 | Audeval et al. | 439/403 |
| 5,127,845 | 7/1992 | Ayer et al. | 439/395 |

*Primary Examiner*—David L. Pirlot

*Attorney, Agent, or Firm*—Trexler, Bushnell, Giangiorgi & Blackstone, Ltd.

[57] ABSTRACT

A terminal block mounts a plurality of bi-ended insulation displacement connector type terminal clips formed of an electrically conductive material, each terminal clip having a base portion and a pair of similar insulation displacing wire-engaging portions projecting oppositely outwardly from the base portion. A plurality of activators are configured for selectively electrically coupling wires to the terminal clips. A block body formed of an electrical insulator material has an upper block section and a lower block section configured for releasably lockingly interengaging the upper block section. Alignment structures are formed respectively on the upper and lower block sections for coaxially aligning respective ones of the walls and cavities. Each pair of coaxially aligned cavities are configured for surroundingly receiving one of the terminal clips with the wire-engaging portions thereof extending toward one of said opposite open ends of each cavity, and each cavity being configured for receiving an activator slidably movable therein between a first position for permitting the insertion of a conductor into the activator externally of an associated cavity, and a second position for engaging a conductor inserted into the activator with the wire-engaging portion of a terminal clip in the associated cavity.

17 Claims, 4 Drawing Sheets

INSULATION DISPLACEMENT CONNECTOR TERMINAL BLOCK

BACKGROUND OF THE INVENTION

The present invention relates to terminal blocks and more particularly to a terminal block of the type which uses insulation displacement connector (IDC) terminal clips for terminating and interconnecting conductors such as telecommunications conductors.

Terminal blocks are utilized in the telecommunications industry to provide an interconnection point for the individual line pair conductors of multi-pair cables. Such terminal blocks may provide interconnections between cables from the central office and subscriber cables or interconnections between a central office cable and a multi-pair cable servicing a local area such as a housing subdivision. Terminal blocks intended for use indoors generally utilize insulation displacement connector (IDC) terminal chips. This type of connector automatically pierces the insulation of a portion of the wire to establish an electrical connection when the wire is inserted in the connector by means of a suitable tool.

One particularly useful terminal block of this type is illustrated and described for example in prior U.S. Pat. No. 4,652,070. This patent discloses a terminal block which advantageously utilizes activators which are captively mounted in the terminal block and associated with each IDC terminal clip to accomplish connection of a conductor with the clip, in place of the special hand tool normally required for this purpose. While this type of terminal block has found widespread acceptance there remains room for further improvement. For example, a second wire connection to each terminal clip in blocks of this type is accomplished by a wire wrap operation. Thus, the opposite end of the terminal clip generally comprises a wire wrap post which projects outwardly toward the opposite side of the terminal block. Generally speaking, terminal blocks of this type are preconnectorized. That is, an appropriate cable stub is provided, having its respective conductors factory prewired to the respective wire wrap terminals of the terminal clips within the block. However, such factory prewiring of cable stubs to the block is relatively labor intensive and hence expensive.

Terminal blocks are also known in which the terminal clips comprise bi-ended insulation displacement type clips. That is, both ends of the terminal clip are of the IDC type in which a conductor's insulation is pierced to establish electrically conductive contact with the clip, when the conductor is pressed into the clip by the use of a suitable tool designed for this purpose. Terminal blocks having such bi-ended or oppositely outwardly facing IDC type terminal clips are shown for example in prior U.S. Pat. Nos. 4,059,331 and 4,106,837.

Other terminal blocks are "one-sided" and use IDC's having multiple clips extending from a common base to accommodate all wire connections on the same side of the block. Such terminal blocks are shown for example in prior U.S. Pat. Nos. 3,957,335 and 5,127,845.

It is to be noted that in the above-mentioned '331 and '837 patents, each of the IDC terminal clips is assembled with the block by a press fitting operation in which the IDC terminal clip must be pressed into position within the block. In the above-mentioned '070 patent, the IDC terminal clip may be accurately longitudinally positioned within a mounting slot by providing an outwardly projecting shoulder on the clip which is pressed into engagement or seated with respect to a complementary projecting shoulder in a recess or cavity within the block. This patent also suggests that the IDC is to be "wedged" into its aperture in the block. However, it is important that the terminal clip be retained against movement in response to the pressure of the activator or other tool when pressing a wire conductor into the IDC clip portion with a force sufficient to achieve piercing of the conductor and electrically conductive contact with the IDC terminal clip. In such a press-fitting or "wedging" operation, a uniform and repeatable dislodgement or pushout force cannot always be predicted. For example, the metal terminal may strip or damage portions of the plastic block upon insertion, resulting in poor seating and insufficient force of engagement therebetween. Also, the IDC clip may not always be inserted in the correct alignment or orientation, or to the correct depth within the block.

In the case of double or bi-ended IDC clips as in the above '331 and '837 patents, it may also be difficult to assure that the terminal clip is properly centered within the block as a result of the press fitting operation. Moreover, this press fitting operation requires the use of special tools, special processing steps, etc. and thus adds to the expense of production and assembly of terminal blocks of this type.

As mentioned hereinabove, in prior U.S. Pat. Nos. 4,957,335 and 5,127,845 there is shown and described an IDC terminal block of the type in which the terminals project from only one side of the block. Interconnections are accomplished by means of multiple IDC's projecting from a single base portion. This base portion is mounted within the block by providing a separate back panel or cover which is suitably affixed to a rear surface of the block following the disposition of the terminals within suitable slots or cavities in the block. However, this construction and technique is not applicable in the case of bi-ended or oppositely outwardly projecting IDC clips of the type shown for example in the '331 and '837 patents, or for that matter the terminal clip of the type shown in the '070 patent, which has a wire wrap post projecting oppositely of the IDC portion.

OBJECTS AND SUMMARY OF THE INVENTION

It is a general object of this invention to provide a novel and improved insulation displacement connector (IDC) type of terminal block which provides IDC type terminations extending oppositely outwardly of respective front and rear sides of the block to allow all wire connections to the block to be done in the field without use of a specialized tool or the like.

A related object is to provide an improved IDC type terminal block in accordance with the foregoing object in which the construction and assembly of the various parts of the block are greatly simplified.

Briefly, and in accordance with the foregoing objects, the present invention provides a terminal block comprising a plurality of bi-ended insulation displacement connector type terminal clips formed of an electrically conductive material, each terminal clip having a base portion and a pair of similar insulation displacing wire-engaging portions projecting oppositely outwardly from said base portion; a plurality of activators configured for selectively electrically coupling wires to said terminal clips; a block body formed of an electrical insulator material; said block body comprising an upper block section and a lower block section configured for releasably lockingly interengaging said upper block section to form said block body, each of said upper block section and said lower block section having a base and a plurality of generally parallel substantially equally spaced walls extending substantially equidistantly outwardly of said base and defining therebetween a plurality of similar elongate open-ended cavities extending through said base; alignment means formed respectively on said upper and lower block sections for coaxially aligning respective ones of said walls and cavities, such that one of the open ends of each cavity coaxially aligns with an open end of a corresponding cavity at respective base portions of the upper and lower block sections, and such that opposite open ends of each cavity face respectively oppositely outwardly when the sections are interengaged; each pair of said coaxially aligned cavities being configured for surroundingly receiving one of said terminal clips with said wire-engaging portions thereof extending toward said opposite one of said open ends of each cavity, and each cavity being configured for receiving an activator slidably movable therein between a first position for permitting the insertion of a conductor into said activator externally of cavity, and a second position for engaging a conductor inserted into said activator with the wire-engaging portion of a terminal clip in said associated cavity.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
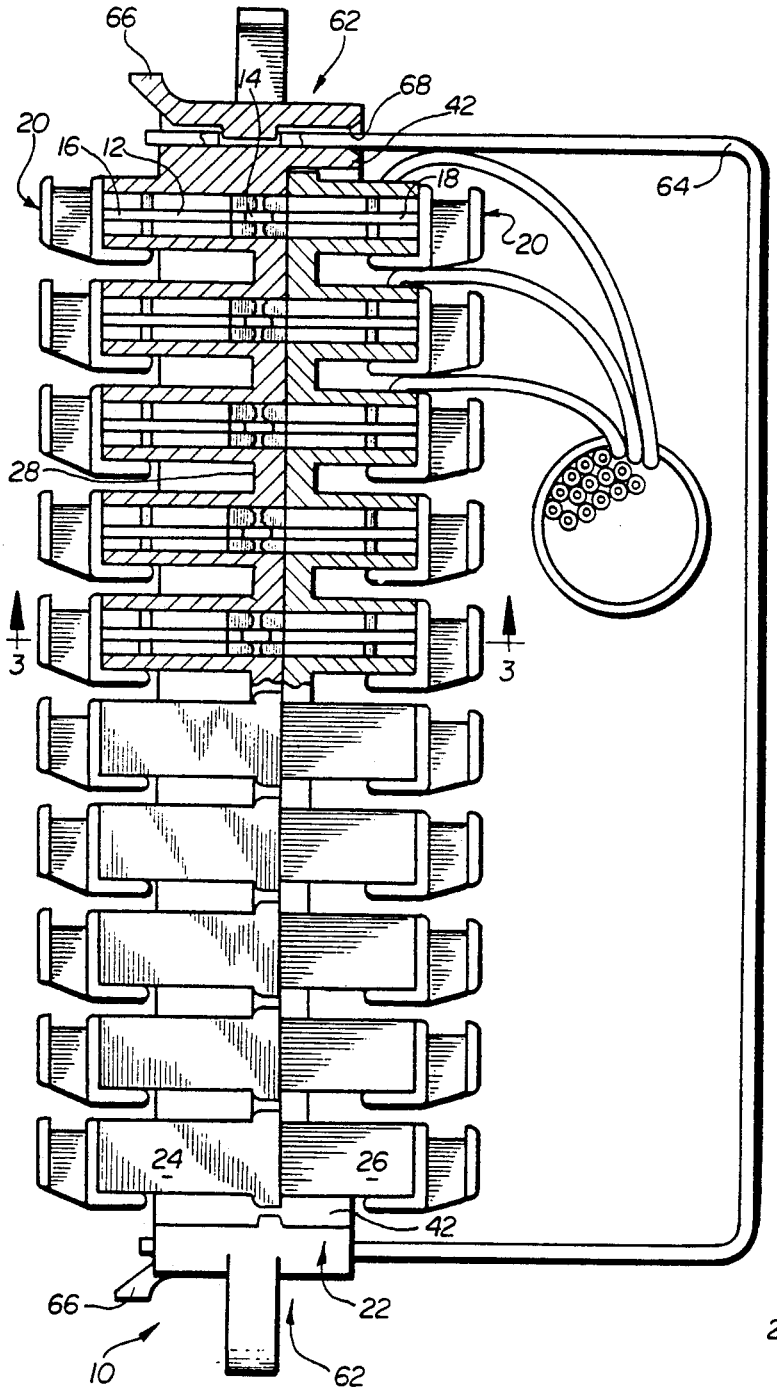
FIG. 1 is a side elevation, partially in section, illustrating a terminal block in accordance with the invention.
Figure 2:
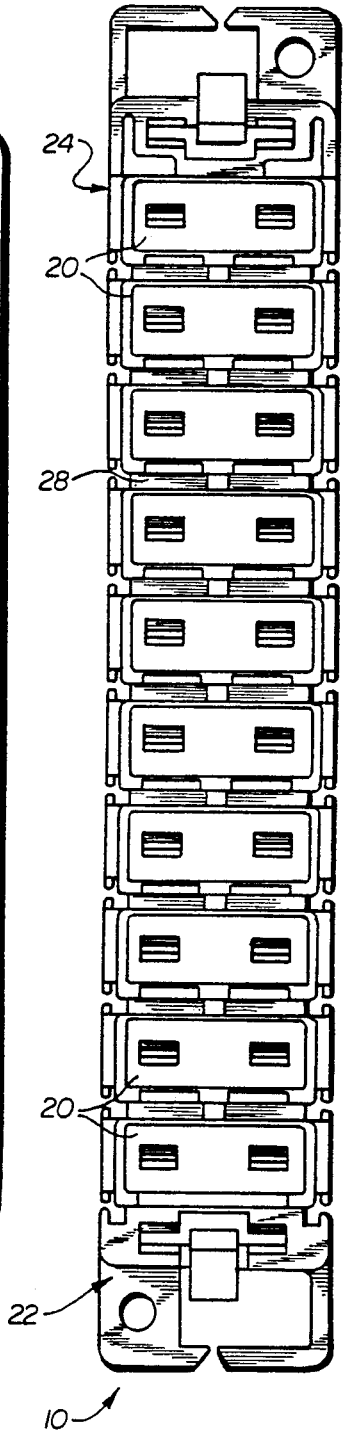
FIG. 2 is a top plan view of the terminal block of FIG. 1.
Figure 3:
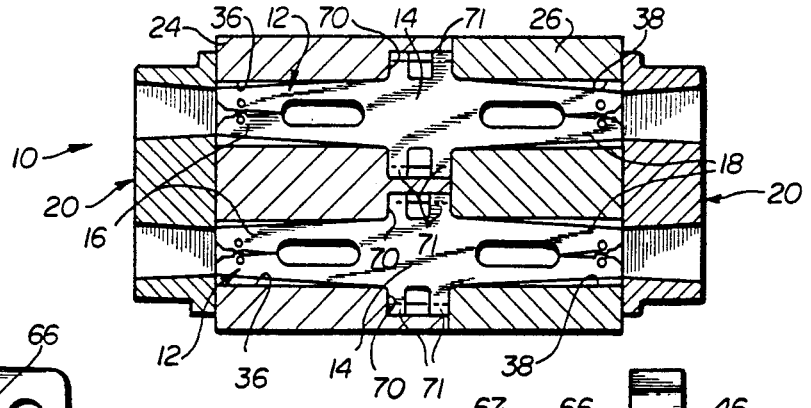
FIG. 3 is a partial sectional view taken generally along the line 3—3 of FIG. 2.
Figure 4:
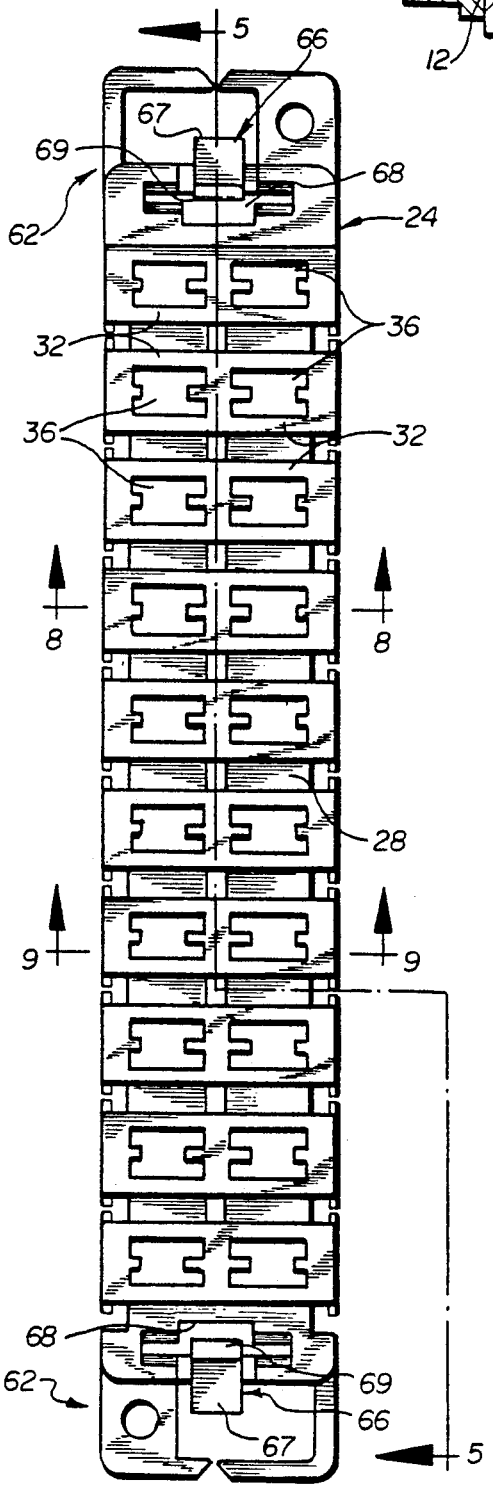
FIG. 4 is a top plan view of an upper block section of the terminal block of the invention.
Figure 5:
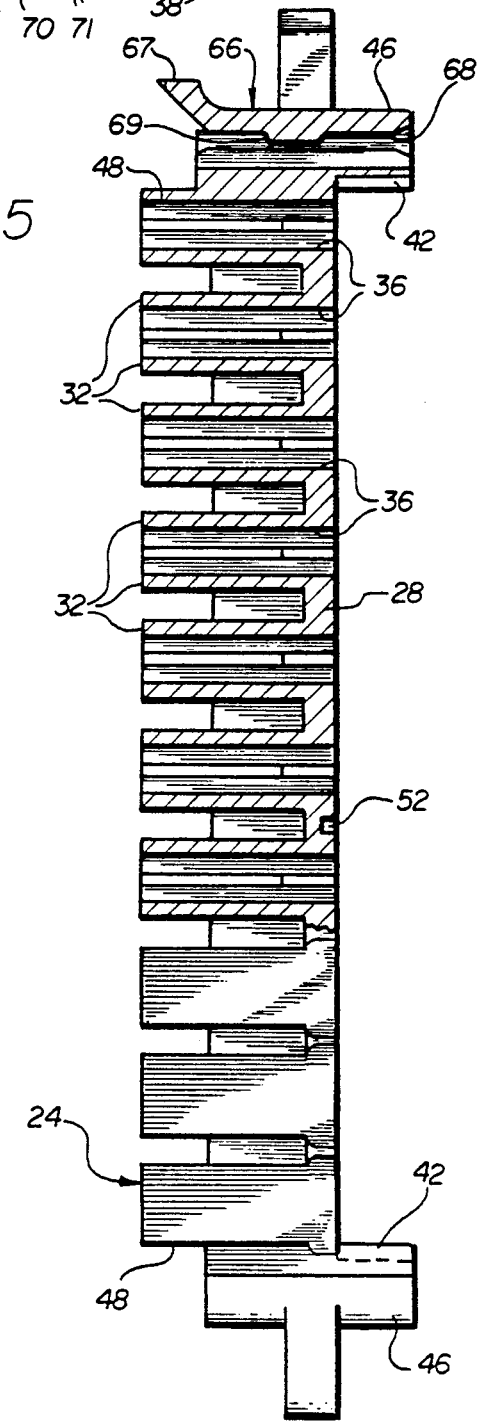
FIG. 5 is a side elevation, partially in section, of the upper block section of FIG. 4.
Figure 6:
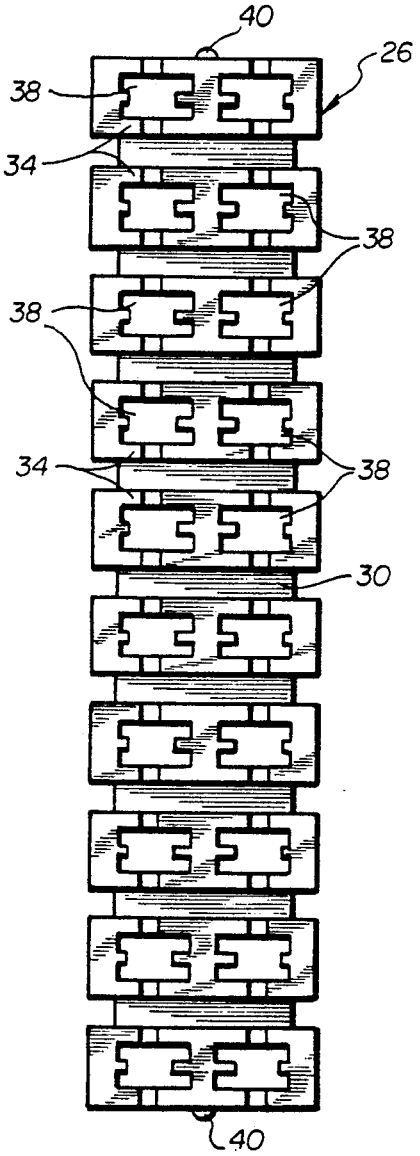
FIG. 6 is a top plan view of a lower block section of the terminal block of the invention.
Figure 7:
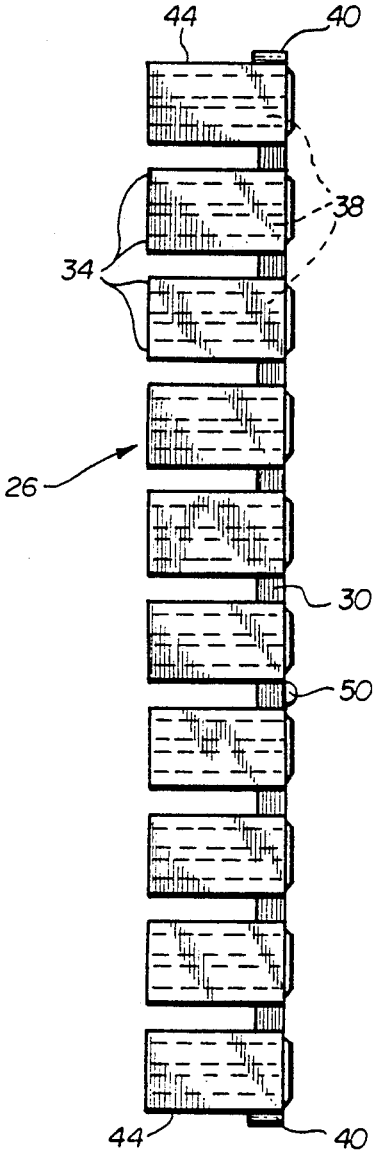
FIG. 7 is a side elevation of the lower block section of FIG. 6.

Referring now to the drawings and initially to FIGS. 1–3, the terminal block in accordance with the invention is designated generally by the reference numeral 10. The terminal block 10 includes a plurality of bi-ended insulation displacement connector (IDC) terminal clips 12, as best viewed in FIG. 3. As shown in FIG. 3, each of these bi-ended terminal clips 12 has a base portion 14 and a pair of opposing, oppositely projecting similar insulation displacing wire-engaging portions 16, 18 projecting oppositely outwardly from the base portion 14. The construction of the insulation displacing wire-engaging portions is preferably as illustrated and described in U.S. Pat. No. 4,919,622.

The terminal clips 12 are arrayed in the illustrated embodiment in side-by-side pairs within the terminal block 10. However, other arrangements of terminal clips within the block 10 may be utilized without departing from the invention.

Associated with each of the pairs of terminal clips 12 in the illustrated embodiment is a activator member 20. Thus, one activator 20 is associated with the first wire-engaging end 16 while a second such activator 20 is associated with the opposite wire engaging end 18 of each of the terminals 12, as best viewed in FIG. 3. It should be noted that like the terminals 12, the activators 20 may be configured to operate in connection with fewer or more terminal clips, which may be arranged in any desired configuration relative to terminal block 10, without departing from the invention. Moreover, terminal clips having multiple wire-engaging portions projecting from each end of base 14 may be utilized to accommodate multiple wire interconnections or terminations, if desired, without departing from the invention.

Referring also to FIGS. 4–9, the terminal block 10 includes a block body 22 formed from a dielectric or electrical insulator material, and preferably a durable, moldable plastics material. The block body 22 comprises an upper block section 24 and a lower block section 26 which are configured for releasably lockingly interengaging to form the block body 22. Each of the upper block section 24 and lower block section 26 comprises a base portion 28, 30 and a plurality of generally parallel and substantially equally spaced walls 32, 34 which extend substantially equidistantly outwardly of the respective base portions 28 and 30. These walls 32 and 34 define therebetween a plurality of similar elongate open-ended cavities 36 and 38 which extend through the respective bases 28 and 30.

The upper and lower block sections 24, 26 are additionally provided with alignment means for coaxially aligning respective ones of the walls 32, 34 and cavities 36, 38. As best viewed in FIGS. 4–7, these alignment means comprise complementary formed interengagable projecting means or raised ridges 40 and recess means or recessed grooves 42 which are formed on the upper and lower block sections 24, 26. In the illustrated embodiment, the raised ridges 40 are formed on opposite end walls 44 of the lower body section 26, while the complementary recessed grooves 42 are formed on the upper block section 24.

More particularly, the upper block section 24 includes respective extensions or arms 46 which project from opposite end walls 48 thereof. The arms are located for resiliently grippingly engaging the opposite end walls 44 of the lower block section 26. The plastics material of which the block sections are formed provides sufficient flexibility or resiliency to allow a resilient mating engagement between the arms 46 and walls 44 in this regard. The grooves 42 are formed on inwardly facing surfaces of the arms 46 to align with and slidably engage the raised ridges 40 on the end walls of the lower block section 26, as the upper and lower block sections are slidably engaged in such a manner as to bring their base portions 28, 30 into face-to-face abutting relation.

An additional alignment pin or projection 50 projecting from the base portion 30 of the lower block section 26, and a complementary receiving recess or aperture 52 in the base portion 28 of upper block section 24 are also provided to facilitate proper alignment of the upper and lower block sections in the illustrated embodiment. The alignment of the upper and lower block sections is such that the open end of each cavity 36 in the base 28 of upper block section 24 coaxially aligns with an open end of a corresponding cavity 38 in the base 30 of lower block section 26. Thus opposite open ends of each of respective cavities 36 and 38 face respectively oppositely outwardly when the block sections 24, 26 are engaged. As best viewed in FIG. 3, each of the coaxially aligned pairs of cavities 36 and 38 is configured for surroundingly receiving one of the terminal clips 12 with the wire-engaging portions 16, 18 thereof extending toward the oppositely outwardly facing open ends of the cavities 36 and 38. As mentioned above, the terminals, and hence the cavities 36, 38 are provided in side-by-side pairs in the illustrated embodiment. However, other arrangements could be used without departing from the invention.

Referring now also to FIGS. 10–13, each of the cavities 36 and 38 is also configured for receiving an activator 20 slidably movable therein. As best viewed in FIGS. 12 and 13, the activator 20 is slidably movable between a first position for permitting insertion of a conductor 60 into the activator 20 and a second position for engaging the conductor 60 previously inserted into the activator with the wire-engaging portion 16 or 18 of the terminal clip 12 in the associated cavity 36 or 38.

In the illustrated embodiment, the terminal block also includes mounting means 62 for mounting the block to a mounting bracket 64. The mounting bracket 64 may be configured for mounting a plurality of similar terminal blocks 10 in a side-by-side array. As best viewed in FIGS. 4 and 5, the mounting means 62 comprises resilient, bracket-engaging clip means 66 which may be formed on either the upper or lower sections 24, 26 but in the illustrated embodiment are formed at the opposite ends of the upper block section 24. In the illustrated embodiment, respective through slots 68 are formed at opposite ends of upper block section 24, preferably in the projecting arms 46 thereof. These slots 68 are formed for receiving a complementary engagement portion of the mounting bracket 64 therewithin. The clips 66 are located and configured for extending into these slots 68 for resiliently engaging the portion of the bracket 64 which extends into the slot 68. Preferably, the clips 66 include outwardly extending, manually graspable lever portions 67, to facilitate engagement and disengagement of an inwardly projecting part 69 of the clip 66 with the portion of the bracket 64 in the slot 68.

Figure 8:
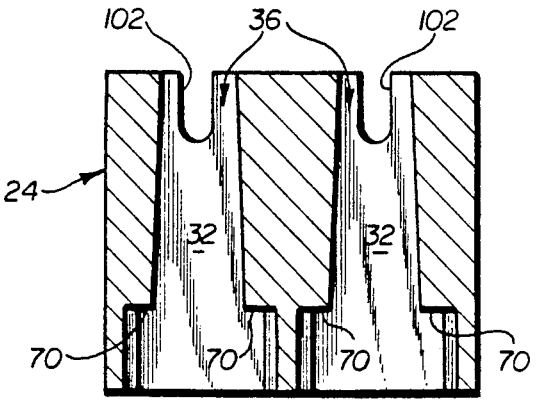
FIG. 8 is a sectional view taken generally along the line 8—8 of FIG. 4.
Figure 9:
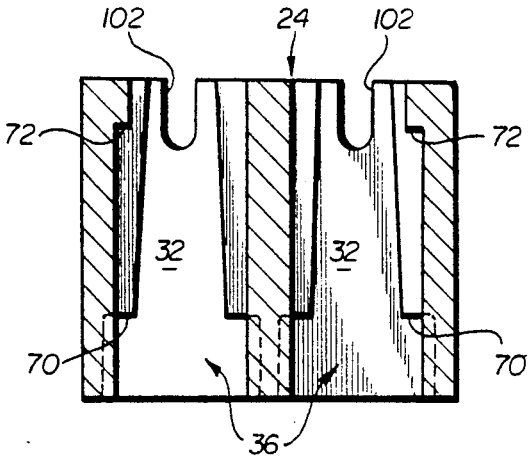
FIG. 9 is a sectional view taken generally along the line 9—9 of FIG. 4.
Figure 10:
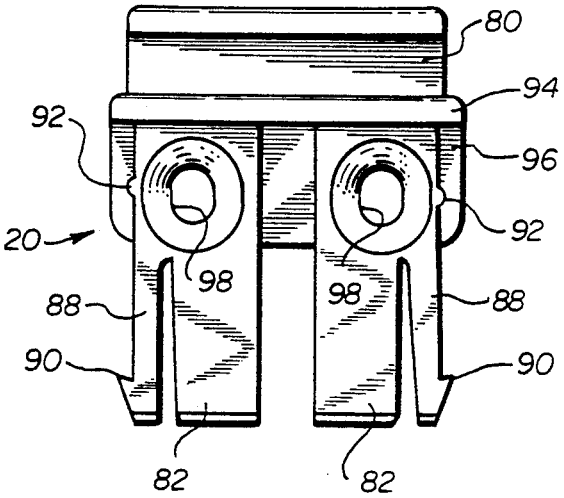
FIG. 10 is a plan view of an activator in accordance with the invention.
Figure 11:
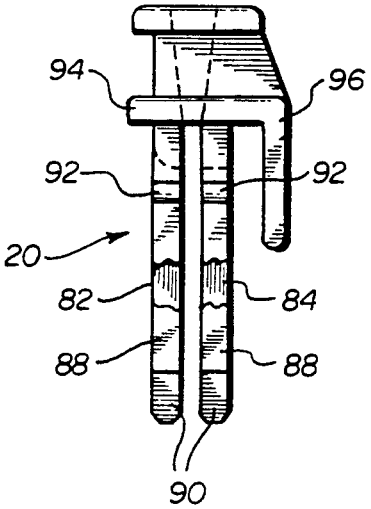
FIG. 11 is side elevation of the activator of FIG. 10.

As best shown in FIGS. 3, 8 and 9, the cavities 36, 38 and the terminal clips 12 include cooperating interengagable projections and recesses for fixedly engaging one of the terminal clips within each pair of aligned cavities 36, 38. In this regard, the base portion 14 of each terminal clip will be seen to extend oppositely outwardly to present respective shoulders 71 which engage complementary facing shoulders 70 within each cavity 36. The cavities 38 of the lower block section 26 terminates at its base portion 30 with a width similar to the smaller of the two widths of the cavities 36 defined at shoulders 70. Accordingly, the enlarged base sections 14 of the clips 12 are firmly engaged between the shoulders 70 formed on the upper block sections 24 and facing surfaces of the base portion 30 of the lower block section 26.

Preferably, the upper and lower block sections are fixed together by suitable adhesive means, such as by sonic welding, when the respective base portions 28 and 30 thereof are engaged and the respective alignment means 40, 42 and 50, 52 are aligned and engaged. Hence, the engagement of the terminal clips is such as to readily permit the pressing of a conductor into the wire-engaging portion on each end of each terminal clip with a force sufficient to strip the insulation from the conductor and cause electrically conductive contact between the conductor and the wire engaging portion without dislodging the terminal clip from the cavity. Moreover, the overall configuration of each cavity 36, 38 is such as to prevent any substantial movement or dislodgment of the clip from its substantially centered condition within the cavity during the insertion or removal of wires relative to the terminal clip.

In this regard, it will be seen that a sufficient gap or space is left in each cavity 36, 38 adjacent the upper end of each wire-receiving portion 16, 18 to permit relative outward flexing or parting of the portion 16, 18 to a degree sufficient to receive a conductor 60 as the same as pressed into engagement therewith by action of the activator 20. The structure and operation of an IDC terminal clip of this type is more fully described in the above referenced U.S. Pat. No. 4,919,622, which is incorporated herein by reference in this regard.

Figure 12:
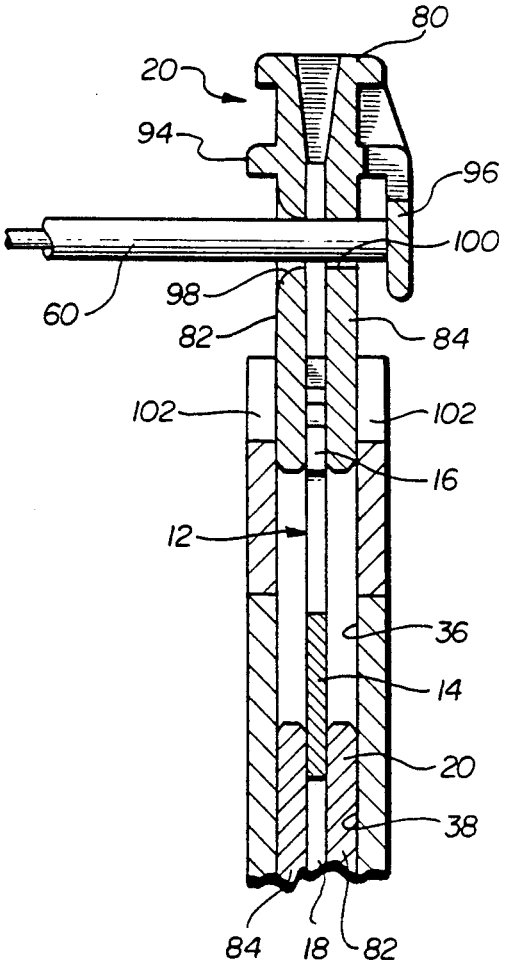
FIGS. 12 and 13 are partial side elevations, partially in section, illustrating insertion of a wire into a clip-type terminal in a terminal block, by use of an activator, in accordance with the invention.
Figure 13:
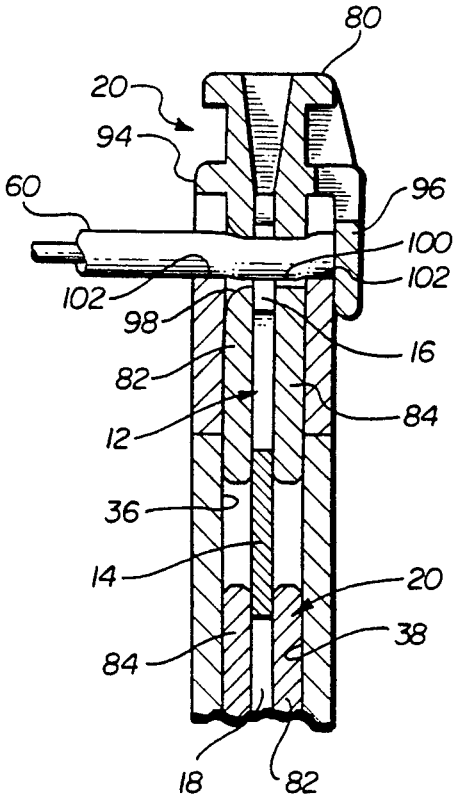

Referring now to FIGS. 10–13, the activator 20 and its operation relative each cavity 36, 38 is substantially similar to that illustrated and described in the above-referenced U.S. Pat. No. 4,652,070. In this regard, the activator 20 includes a gripping portion 80 for manual engagement thereof for movement between the first and second positions as illustrated in FIGS. 12 and 13. A pair of parallel spaced legs 82, 84 extend from the gripping portion 80 and are configured for sliding engagement with one of the cavities 36, 38. The spacing between the legs 82, 84 is somewhat greater than the thickness of the terminal clips 12 for permitting the legs 82, 84 to extend to either side of, and slide freely with respect to, the terminal clips 12 within respective cavities 36, 38. In similar fashion to the terminals 12 and cavities 36, 38, each activator 20 is configured for simultaneous engagement with a pair of side-by-side cavities 36, 38. Hence, two similar pairs of legs 82, 84 extend from the base 80. The legs 82, 84 are of a length at least as great as the depth of insertion of conductor 60 required for piercing of the insulator and conductive engagement between the conductor 60 and a wire engaging portion 16 or 18 of a terminal clip 12. In the illustrated embodiment, legs 82, 84 extend well beyond this depth.

Each leg 82, 84 is provided with a flexible, resilient engagement portion 88 which terminates in an outwardly flared barb-like projection 90 for engaging a second shoulder portion 72 formed in each of cavities 36 and 38. This holds the activator member captive in the cavity once initially inserted therein and also defines the first position thereof shown in FIG. 12, extending outwardly of the cavity to receive a conductor 60. Each of legs 82, 84 is preferably the same length as the flexible resilient members 88 and their terminal barb portions 90.

Each of the legs 82, 84 further includes an outwardly projecting detent surface 92 which releasably snappingly engages or detents with one of shoulders 72 to define the second or fully advanced position of the activator 20 with respect to each cavity 36, 38 as illustrated in FIG. 13. The gripping portion 80 has an outwardly extending peripheral rim portion 94 for providing a stop or abutment surface for abutment against an upper edge portion of respective walls 32 and 34 to also define the fully advanced or second position of the actuator 20 as shown in FIG. 13. A downwardly depending skirt portion 96 extends from the rim 94 to one of the side of the actuator, spaced from one of the legs 82, 84 to provide a stop surface for defining a fully advanced position of conductor 60, as shown in FIGS. 12 and 13 with respect to wire engaging surfaces of the activator, which are defined by aligned through openings 98, 100 in the respective legs 82 and 84 thereof. Cooperatively, the respective walls 32 and 34 include open-ended slots or recesses 102 for permitting advancement of the conductor 60 by the activator 20 into engagement with the wire-engaging portions 16 and 18 of the terminal clip 12, as illustrated in FIGS. 12 and 13.

Accordingly, it will be seen that the respective wire engaging surfaces or apertures 98, 100 of the legs 82, 84 engaged an outer insulation portion of a conductor 60 to either side of an associated terminal clip 12 which is located between the legs 82 and 84. The legs 82, 84 and cavity 36 or 38 are cooperatively configured for aligning a portion of the insulated conductor 60 intermediate the legs of 82 and 84 of the activator 20 with the wire-engaging portion 16 or 18 of the terminal clip 12 for piercing the insulation of the conductor 60 and electrically engaging a conductor with the terminal clip when the activator is advanced from the first position to the second position as is illustrated in FIGS. 12 and 13. The through openings 98 and 100 are thus configured and located for aligning the conductor 60 with an entrance to the wire-engaging portion 16 or 18 of the terminal clip within the slot 36 or 38 when the activator 20 is in the first position as indicated in FIG. 12, and for aligning the conductor 60 with the wire engaging portion 16 or 18 of the terminal clip 12 for causing piercing of the insulation of the conductor and electrically conductive contact of the conductor with the wire-engaging portion when the activator is in the second position as illustrated in FIG. 13.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A terminal block comprising: a plurality of bi-ended insulation displacement connector type terminal clips formed of an electrically conductive material, each terminal clip having a base portion and a pair of similar insulation displacing wire-engaging portions projecting oppositely outwardly from said base portion; a plurality of activators configured for selectively electrically coupling wires to said terminal clips; a block body formed of an electrical insulator material; said block body comprising an upper block section and a lower block section configured for releasably lockingly interengaging said upper block section to form said block body, each of said upper block section and said lower block section having a base and a plurality of generally parallel substantially equally spaced walls extending substantially equidistantly outwardly of said base and defining therebetween a plurality of similar elongate open-ended cavities extending through said base; alignment means formed respectively on said upper and lower block sections for coaxially aligning respective ones of said walls and cavities, such that one of the open ends of each cavity coaxially aligns with an open end of a corresponding cavity at respective base portions of the upper and lower block sections, and such that opposite open ends of each cavity face respectively oppositely outwardly when the sections are interengaged; each pair of said coaxially aligned cavities being configured for surroundingly receiving one of said terminal clips with said wire-engaging portions thereof extending toward one of said opposite open ends of each cavity, and each cavity being configured for receiving an activator slidably movable therein between a first position for permitting the insertion of a conductor into said activator externally of an associated cavity, and a second position for engaging a conductor inserted into said activator with the wire-engaging portion of a terminal clip in said associated cavity.

2. A terminal block according to claim 1 wherein said alignment means include complementary formed interengagable projecting means and recess means formed on said upper and lower body sections.

3. A terminal block according to claim 1 wherein said cavities and said terminal clips include cooperating interengagable projections and recesses for fixedly engaging and positioning one of said terminal clips within each of said cavities with a force of engagement sufficient to permit pressing of a conductor into the wire-engaging portion on each end of said terminal clip with a force sufficient to strip the insulation from the conductor and cause electrically conductive contact between the conductor and the wire-engaging portion without dislodging said terminal clip from said cavity.

4. A terminal block according to claim 1 wherein said upper and lower block sections include opposite end walls, and wherein one of said upper and lower sections includes a pair of arms projecting from said opposite end walls thereof, said arms being located and configured for resiliently grippingly engaging the opposite end walls of the other of said upper and lower block sections therebetween.

5. A terminal block according to claim 4 wherein said alignment means comprise complementary formed, slidably interengagable raised ridges and recessed grooves formed respectively on the resilient arms projecting from one of said upper and lower block sections and the opposite end walls of the other of said upper and lower block sections, respectively.

6. A terminal block according to claim 1 and further including mounting means for mounting said terminal block to a mounting bracket, said mounting means comprising resilient, bracket-engaging clip means formed on one of said upper and lower sections.

7. A terminal block according to claim 6, wherein said bracket-engaging clip means include outwardly extending manually engageable lever means for resiliently flexing said clip means for engagement and disengagement with said mounting bracket.

8. A terminal block according to claim 1 wherein each of said activators comprises a gripping portion for manually engaging said activator for movement between said first and second positions, a pair of parallel spaced legs extending from said gripping portion and configured for sliding engagement with one of said cavities, the spacing between said legs being somewhat greater than the thickness of one of said terminal clips for permitting said legs to extend to either side of and slide freely with respect to one of said terminal clips, said legs further being of a length at least as great as a depth of insertion of a conductor required for conductive engagement with said a wire-engaging portion of said terminal clip, a pair of aligned wire-engaging surfaces formed in said legs for engaging an outer insulation portion of an insulated conductor to either side of an associated terminal clip located between said legs, said legs and said cavity being configured for aligning a portion of an insulated conductor intermediate said legs with said wire-engaging portion of said terminal clip for piercing the insulation of said conductor and electrically engaging the conductor with the terminal clip when the activator is advanced from said first position to said second position.

9. A terminal block according to claim 8 wherein said wire-engaging surfaces of said activator are defined by aligned through openings in said legs thereof, said openings being configured and located for aligning a conductor with an entrance to said wire-engaging portion of said terminal clip when said activator is in said first position and for aligning a conductor with said wire-engaging portion of said terminal clip for piercing the insulation and causing electrically conductive contact of a conductor with said wire-engaging portion when said activator is moved to said second position.

10. A terminal block according to claim 8 wherein said gripping portion of each said activator includes an abutment surface for engaging said walls about outwardly facing ones of said open ends of said cavities to thereby define said second position of said activator.

11. A terminal block according to claim 8 and further including detent means formed respectively on said legs of said activator and in each of said cavities for releasably retaining said activator in said second position.

12. A terminal block according to claim 8 wherein said legs of said activator include flexible retaining portions and wherein said walls of said upper and lower block portion include internal shoulder surfaces within said cavities for engagement with said flexible retaining portions to define said first position of said activator and to retain said legs slidably captive within said cavity.

13. A terminal block according to claim 12 wherein said flexible retaining portions terminate in laterally projecting barb members having downwardly facing ramp surfaces, said flexible retaining portions being sufficiently resilient to compress and thereafter return to an uncompressed condition as said legs are initially slidably introduced to said cavity to permit initial snapping engagement of said barbs over said shoulder surfaces.

14. A terminal block according to claim 12 and further including detent means formed respectively on said legs of said activator and in each of said cavities for releasably retaining said activator in said second position.

15. A terminal block according to claim 14, wherein said detent means comprises said internal shoulder surfaces and detent projections on said legs of said activator, located and configured for detenting engagement with said shoulder surfaces.

16. A terminal block according to claim 6 wherein said mounting means further comprises means defining a slot at opposite ends of one of said upper and lower block sections for receiving a portion of a mounting bracket therewithin, said clip means being located and configured for extending into said slot for resiliently engaging said portion of said bracket.

17. A terminal block according to claim 16, wherein said bracket-engaging clip means include outwardly extending manually engageable lever means for resiliently flexing said clip means for engagement and disengagement with said mounting bracket.

* * * * *